US008777341B2

(12) United States Patent
Amaral et al.

(10) Patent No.: US 8,777,341 B2
(45) Date of Patent: Jul. 15, 2014

(54) SLIDING SHELVES FOR REFRIGERATORS AND FREEZERS

(75) Inventors: Gustavo Gnoatto Amaral, Curitiba (BR); Adriano Davin, Curitiba (BR); Valkiria Pedri Fialkowski, Curitiba (BR); Jacques Edouard de Holanda Miranda, Curitiba (BR); Rodrigo Telles Wolff, Curitiba (BR); Mario Filho Gnypek, Curitiba (BR); Rafael Amaral Alonso Lopes, Curitiba (BR)

(73) Assignee: Electrolux Do Brasil S.A., Curitiba (BR)

( * ) Notice: Subject to any disclaimer, the term of this patent is extended or adjusted under 35 U.S.C. 154(b) by 95 days.

(21) Appl. No.: 13/258,118

(22) PCT Filed: Apr. 16, 2010

(86) PCT No.: PCT/BR2010/000126

§ 371 (c)(1),
(2), (4) Date: Dec. 19, 2011

(87) PCT Pub. No.: WO2010/118492

PCT Pub. Date: Oct. 21, 2010

(65) Prior Publication Data

US 2012/0091084 A1 Apr. 19, 2012

(30) Foreign Application Priority Data

Apr. 16, 2009 (BR) ..... 8900569 U

(51) Int. Cl.
*A47B 96/04* (2006.01)

(52) U.S. Cl.
USPC ..... 312/408; 312/302; 108/74; 108/86; 108/143

(58) Field of Classification Search
CPC . F25D 25/02; F25D 25/024; F25D 2325/021; A47B 96/02; A47B 96/04; A47B 96/025
USPC ..... 312/408, 410, 302, 306; 108/143, 108/74–75, 86, 138, 106–108
See application file for complete search history.

(56) References Cited

U.S. PATENT DOCUMENTS 3,859,932 A * 1/1975 Armstrong et al. ..... 108/75
5,199,778 A 4/1993 Aoki et al.

(Continued)

FOREIGN PATENT DOCUMENTS

DE 19750473 5/1999
JP 57097089 6/1982

(Continued)

OTHER PUBLICATIONS

International Search Report for PCT/BR2010/000126, dated Oct. 22, 2010, 3 pages.

*Primary Examiner* — Hanh V Tran
(74) *Attorney, Agent, or Firm* — Pearne & Gordon LLP

(57) ABSTRACT

Sliding shelves (2*a*, 2*b*, 4*a*, 4*b*) are provided for refrigerators and freezers, which have a movement along side support guides (1) that enable the retracting, fitting and bounce of the shelves, allowing the choice of different configurations for the inner space of the household appliance, according to the area to be used to store food. This configuration enables different arrangement of shelves, including: extended shelves, retracted shelves, vertically bounced shelves, or even, in an associated form, an extended shelf and another bounced one.

9 Claims, 5 Drawing Sheets

(56) References Cited

U.S. PATENT DOCUMENTS

| | | | | |
|---|---|---|---|---|
| 5,299,863 | A | 4/1994 | Albright, Jr. | |
| 5,454,638 | A | 10/1995 | Bird et al. | |
| 6,220,682 | B1 | 4/2001 | Vertullo | |
| 8,403,438 | B2 * | 3/2013 | Park et al. | 312/408 |
| 2006/0097613 | A1 * | 5/2006 | Lee et al. | 312/408 |
| 2007/0096610 | A1 * | 5/2007 | Filho et al. | 312/408 |
| 2010/0109498 | A1 * | 5/2010 | Ramm et al. | 312/408 |

FOREIGN PATENT DOCUMENTS

| | | | | | |
|---|---|---|---|---|---|
| JP | 59056684 | | | 4/1984 | |
| JP | 01084085 | A | * | 3/1989 | F25D 25/02 |
| JP | 07332843 | A | * | 12/1995 | F25D 25/02 |
| JP | 08035765 | A | * | 2/1996 | F25D 25/02 |
| JP | 2002090054 | | | 3/2002 | |
| KR | 20040070986 | | | 8/2004 | |
| KR | 100756887 | | * | 7/2007 | F25D 25/02 |
| WO | 2009155679 | | | 12/2009 | |

* cited by examiner

SLIDING SHELVES FOR REFRIGERATORS AND FREEZERS

FIELD OF THE INVENTION

This invention relates to the field of household appliances, more particularly refrigerators and freezers, particularly to shelves allocated inside refrigerators and freezers used for supporting containers of liquids or foods in general.

The present application is an improvement of the patent application, MU8802268-4, entitled "Guidelines for sliding shelves for refrigerators", filed by the applicant on Jun. 26, 2008.

BACKGROUND OF THE INVENTION

In search for solutions to the rational use of internal space, manufacturers of household appliances, specifically for household refrigerators and freezers, seek to evolve the concepts of adaptability and improvement of the useful space.

The use of shelves in refrigerators aims to provide additional spaces for storing items to be refrigerated, enabling an improved use of the space. This approach, however, limits the use of internal space to items with size compatible with the distance between two subsequent shelves, often conflicting with larger items that need additional space, whose presence is not always frequent.

Thus, it seeks to develop shelves that can be displaced, allowing the release of internal space in accordance with user need.

Detachable shelves arise as a first option, but have the drawback of requiring the product to be stored out of the refrigerator when not in use, which is not always desired for reasons of practicality and even hygiene.

The next step leads to the promotion of sliding shelves in support rails, which can be moved forward or backward so that the user is able to easily access the food. However, they are limited regarding the positioning do not present the possibility to be arranged to save space relatively.

Even with many options for support and wide range of arrangement of accessories, it appears that the prior art presents an optimization problem space according to different usage needs and is also deficient in providing new arrangements for shelves.

State of Art Analysis

Document U.S. Pat. No. 5,199,778 discloses a shelf device for refrigerators that allows the allocation of food storage shelves at different levels, with an adjustment system to adjust the shelves to the size of the food in the vertical direction, but differs significantly in nature and movement characteristics involved in this invention, not colliding with the inventive aspects in question.

Document U.S. Pat. No. 6,220,682 shows a shelf system for refrigerators that includes a wide range of shelves that have opposite sides and are placed in parallel inside the refrigerator and mounted so as to have a selective movement in the longitudinal direction, but provides a retractable displacement, thus is differing itself from the inventive aspects presented herein.

Document U.S. Pat. No. 5,454,638 describes an adjustable shelf system for refrigerators, including a shelf rail to support the partial width. Although the objective of the invention is to slide shelves on a rail, the nature of movements and the design of the rails differ from the aspects presented herein.

Document U.S. Pat. No. 5,299,863 describes a refrigerator with movable inner frames containing a sliding unit inside in the form of a plurality of shelves. It substantially differs from the concept presented herein for not having movement and position variations.

Abstract of the Application

The present invention relates to shelves of refrigerators and freezers, internally arranged and substantially rectangular-shaped, with external frames equipped with recesses and protuberances, in which some of them slides in support guides, which supports both said protuberances, as the shelf itself, depending on where they are positioned. The sliding characteristics in the guides and rotation feature around an imaginary axis, enabling to bounce, allow the shelves to be arranged, at least, in four different positions, according to the required space for the food packaging and also the positioning of these foods in the refrigerator.

In a preferred embodiment the shelves can be arranged in for different positions, the first position contemplating the shelves totally extended, one facing the other. A second position presents the shelves in the retracted position. A third position is obtained in which after retracted, the shelves are bounced vertically. In a fourth position it can be configured so that only the rear shelf can be bounced, while the front shelf remains extended.

The shelves present a central area, substantially rectangular-shaped, which is in its turn, partially encompassed by a frame. The front shelf presents a frame supplied with side protuberances, which may have different sizes and shapes, being said protuberances essentially slide on support guides. The rear shelf presents a frame supplied with a lower recess, substantially round-shaped which accommodates a protuberance of the front shelf, and also is fitted in the side support guide.

The said support guides can be fixed in the internal side of refrigerators or freezers, or may still be stuck between internal parts, such as fixed compartments, support of drawers, or other accessories placed in the refrigerator. Alternatives mounting configurations are also possible as a version in which a guide support is secured to the side of the appliance and another tab is locked in an internal accessory such as a drawer or an ice maker machine. Further, in a constructive embodiment, the guides can be fixed in the side wall itself of some inner accessory.

The external frame and the support guides, in a preferred embodiment, are made of hard polymer. In other embodiments, they can be manufactured with metal alloys, or even comprised other materials, according to the pertinent variations. Likewise, the base, preferably composed of semi-transparent polymer, can be even in glass, metal or other materials according to different uses. In a main embodiment, the base is uniform. In other embodiments, said base can be comprised by grids in different arrangements or even be provided with holes or characteristic relief This type of sliding shelf solves several problems of the art for providing a smooth sliding, without relevant noise and with great ease for moving parts. It also provides an unprecedented arrangement of shelves combination, causing to be obtained different configurations of space without removing any part of the unit. Additionally, it provides shelves that, besides offering smooth movement, have a solid support after displaced due to the practical fitting and locking system.

Objectives of the Application

The first goal is to provide sliding shelves in support guides that can be arranged in different positions according to user's needs, changing different space settings according to different needs.

A second goal is to facilitate the movement of shelves with smoothness, practicality and great noise reduction.

A third goal is to fix the shelves in the end positions by means of fittings and locks.

DESCRIPTION OF FIGURES

For a better understanding of a preferred embodiment of the invention proposed herein, the figures are presented for illustrative purposes, in which.

DETAILED DESCRIPTION OF THE INVENTION

Figure 1:
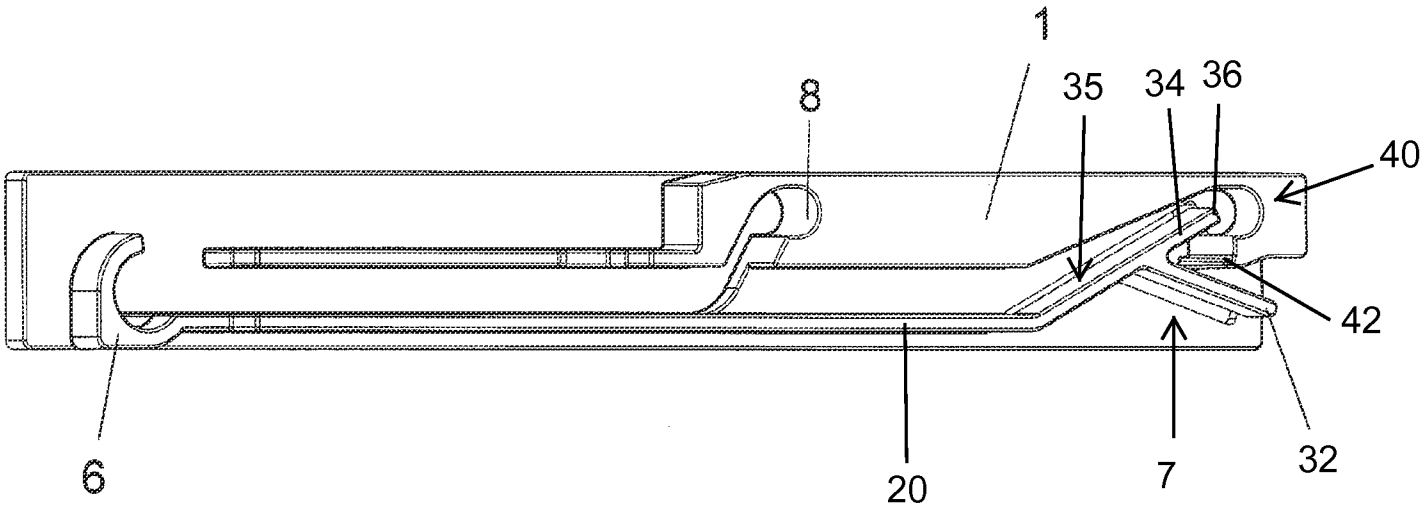
FIG. 1 illustrates, in a perspective view, one of the guides support side.

According to the illustrated in FIGS. 1, 2, 3, 4 and 5, this invention proposes, in its preferred embodiment, at least two sliding shelves, being a first shelf, sliding in the inner area of the side guides 1, comprising a base 4*a*, partially encompassed by a side frame 2*a*, said side frame provided with protuberances 3*a*/3*b*, a second shelf is also presented, consisting of a base 4*b*, partially encompassed by a side frame 2*b*, being said frame fitted with a lower recess 5, which is embedded in the side guide 1, specifically on the rear inner part. Such embodiment allows the set to be rotated in order to provide the bounce. Further, it is part of the solution the support side guides 1, being provided with a plurality of conformations, the locking means 7 and fitting means 6, which function to provide support for the rear shelf and the sliding of the front shelf.

For a first positional configuration, FIG. 1 shows one of the support side guides 1. In this example, the guide 1 is applied on the right side of the inner wall of a refrigerator or freezer, being the shelves set supported by at least two of these guides. The second guide (not illustrated) has the aspect of the first side guide 1 conformed in mirror mode in relation to the first one. Said side support guide 1 comprises a plurality of conformations in order to provide a specific system for the smooth sliding of the lateral protuberances 3*a* and 3*b*, such as track 20, and to support and plug the fit the rear shelf by means of fitting 6. Such guide 1 has recesses of different depths so as to allow said lateral protrusions 3*a* and 3*b* to be fitted or slide into the space in relief, causing the route of each protuberance to be different. Such guide further provides means for fitting 6 that accommodate the lower recess 5 of the rear shelf to the rotation and correct bounce of the shelves. It can also be checked that said guide support is provided with locking means 7 so that the protuberance 3*a* remains within the end fitting 40 and the front shelf does not move along the track 20 of guides 1 when the shelves are arranged in the extended position.

Figure 2:
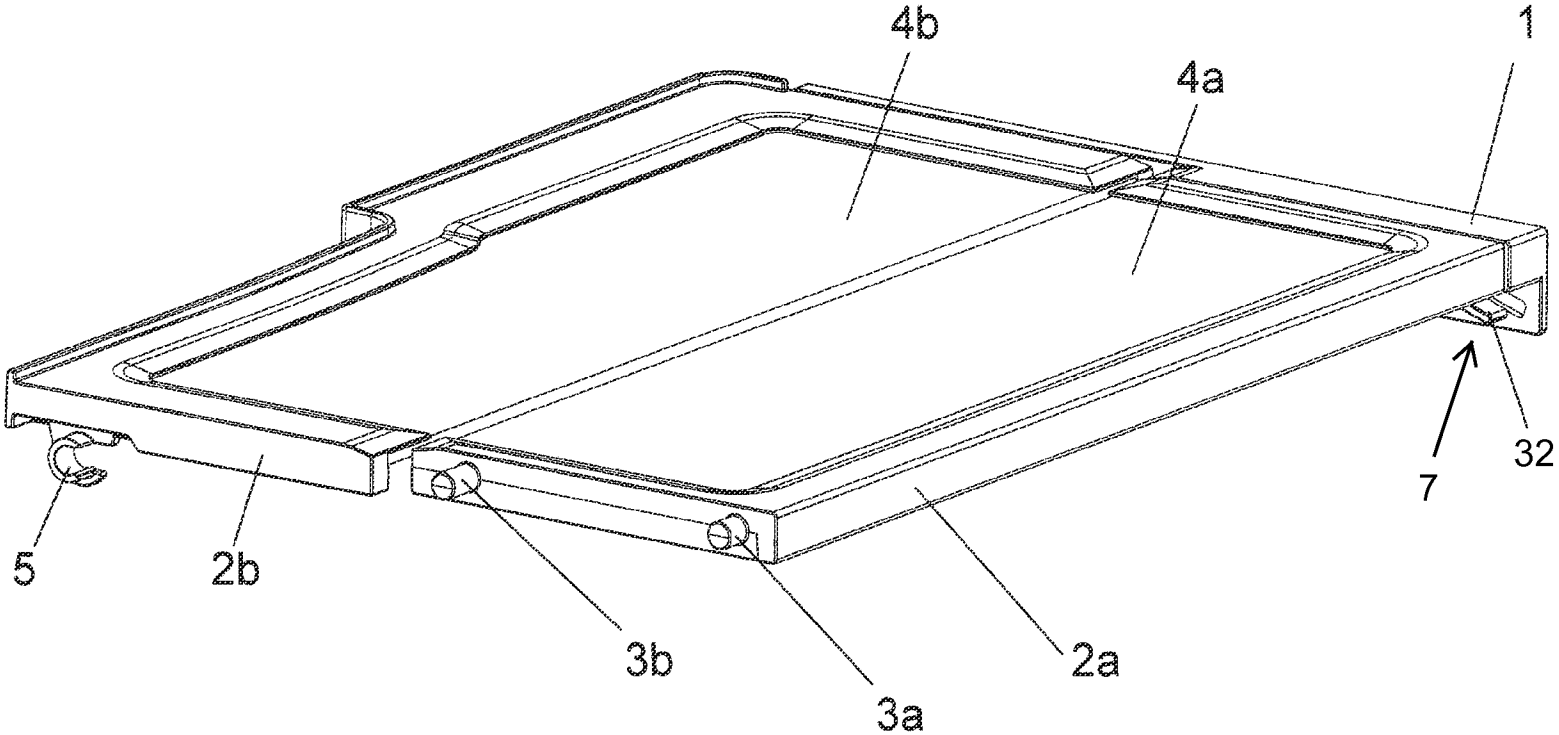
FIG. 2 illustrates, in a perspective view, an arrangement of the shelves in the extended position.

FIG. 2 shows, in addition to the guide support 1, two shelves used in the extended position, which are queued in a horizontal plane and at the same height. In this arrangement, it can be visualized a front shelf base 4*a*, partially encompassed by its frame 2*a*, being said frame provided with two to lateral protuberances 3*a* and 3*b*, being one of which larger 3*b* and another smaller 3*a*. It is still displayed in FIG. 2 the rear base 4*b*, the rear frame 2*b* and the lower recess 5 used as a stopper or end of course of the front shelf, being said recess embedded on the guide 1 specifically by means of fitting 6.

Figure 3:
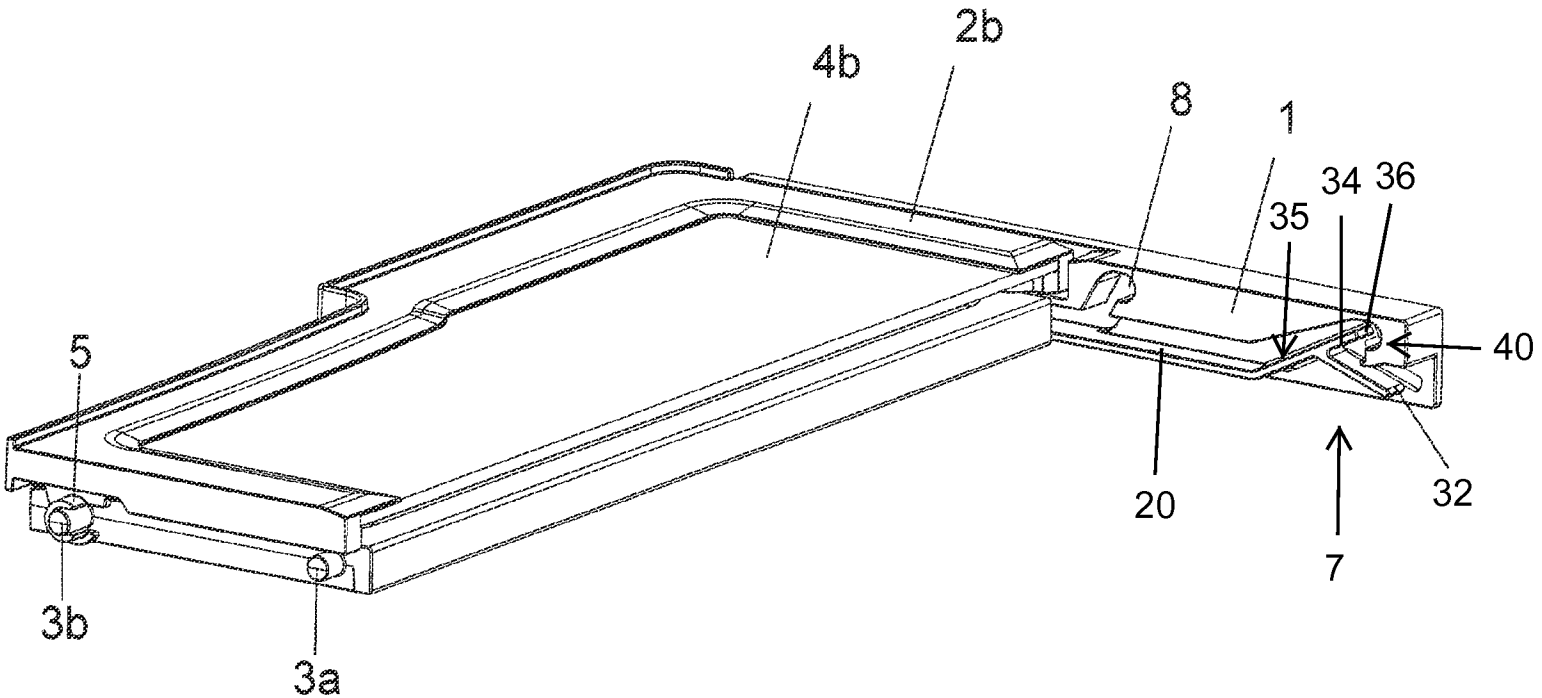
FIG. 3 illustrates, in a perspective view, an arrangement of the shelves in the retracted position.

FIG. 3 shows, in addition to the support guide 1, the two shelves used in the retracted position, being the front part concealed under the rear part, this position allows the bases 4*a* and 4*b* of the shelves remain arranged in parallel, queued and united together by means of the fitting between the protuberance 3*b* and the lower recess 5, and by a fitting on the back of the frames (not shown). The steps to change the shelves of the extended position to the retracted one involve the unlocking of the locking means 7 and then the sliding of the front part backwards along the track 20 until there is a conceal of the front shelf, where there is the snap and the lock of the front set under the rear set. This unlocking, in a preferred embodiment, occurs through the action of pressing the lower part handle 32 of the locking means 7, but alternative embodiments should be considered to allow unlocking variations according to different modes of construction. In the embodiment shown in FIGS. 1, 3, and 4, the locking means 7 includes a resilient arm 34 that is movable, relative to the support guide 1, by pressing upon the handle 32. The resilient arm 34 is coupled to the track 20 and is arranged upwards at an angle, relative to the track 20, to form an incline ramp 35 that leads upwards to the end fitting 40. An end 36 of the resilient arm 34 is located so as to prevent the protuberance 3*a* from leaving the end fitting 40 when the frame 2*a* is in the extended position. Pressing downwards upon the handle 32 causes the end 36 of the resilient arm 34 to be temporarily moved downwards a sufficient amount to enable the protuberance 3*a* to leave the end fitting 40 and travel downwards along the ramp 35 and then along the track 20. The resilient arm 34 can be moved downwards until the end 36 contacts a lower stopper shelf 42 of the end fitting 40.

In order to the front shelf return to the extended position, the said front shelf is slid forward again due to a particular arrangement characterized by different sizes of side protuberances 3*a*/3*b* and different inner conformations in the support guide 1. This difference in size allows the first protuberance 3*a* to slide along the track 20 while passing through the central fitting 8 of the side guide 1 and the protuberance 3*b* to be fitted when passing through said central fitting 8. The protuberance 3*a* slides upwards along the inclined ramp 35 of the resilient arm 34. An angle of the guide 1 can be different than the angle of the ramp 35 so that the guide 1 and ramp 35 converge, and interference of the protuberance 3*a* between the guide 1 and the resilient arm 34 near the top of the ramp 35 can force the end 36 to be temporarily moved downwards a sufficient amount to enable the protuberance 3*a* to enter the end fitting 40. Once the protuberance 3*a* moves beyond the end 36, the resilient arm 34 naturally returns to the position shown in FIG. 1 such that end 36 prevents the protuberance 3*a* from leaving the end fitting 40. The handle 32 of the resilient arm 34 may also be manually pressed upon to move the end 36 temporarily downwards.

Figure 4:
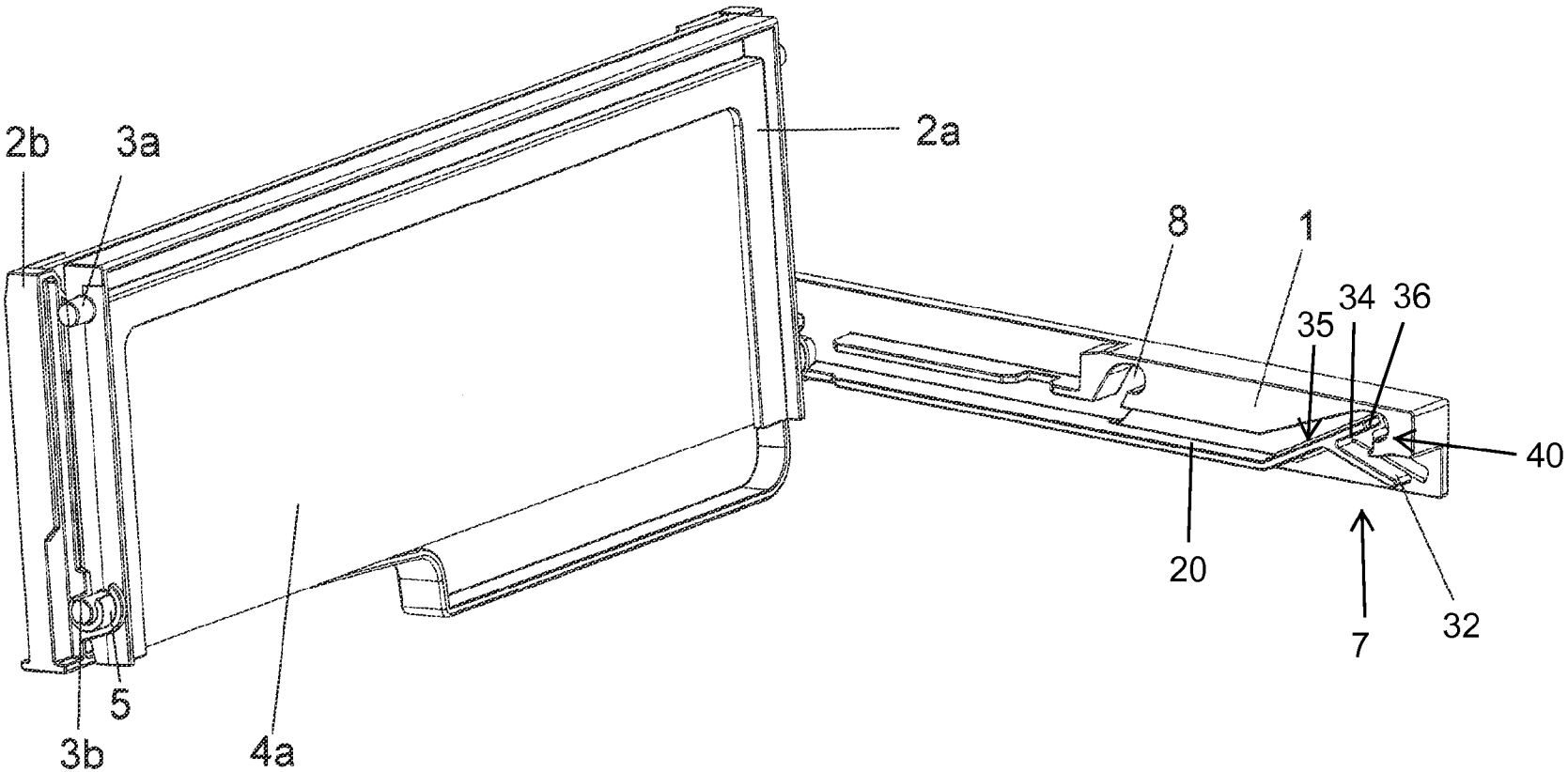
FIG. 4 illustrates, in a perspective view, an arrangement of the shelves in the vertical bounced position.

FIG. 4 shows, in addition to the support guide 1, two shelves used in the bounced position, which are fitted and in the vertical position. In order to the bounce occur from the position shown in FIG. 3, the front of the set is raised (formed by the first concealed shelf under the second one) to a limited position by a stop in the side guide 1, setting an angle between 60 and 120 degrees, preferably 90 degrees, of the shelves in the horizontal plane.

In this position, the side protuberance 3*b* of the frame 2*a* is fitted on the lower recess 5 of the rear frame 2*b*. The set of shelves is rotated under a is virtual axis due to the fitting of the elements of the side protuberance 3*b*, the lower recess 5 and fitting mean 6, thus promoting the practical bounce of the set.

Figure 5:
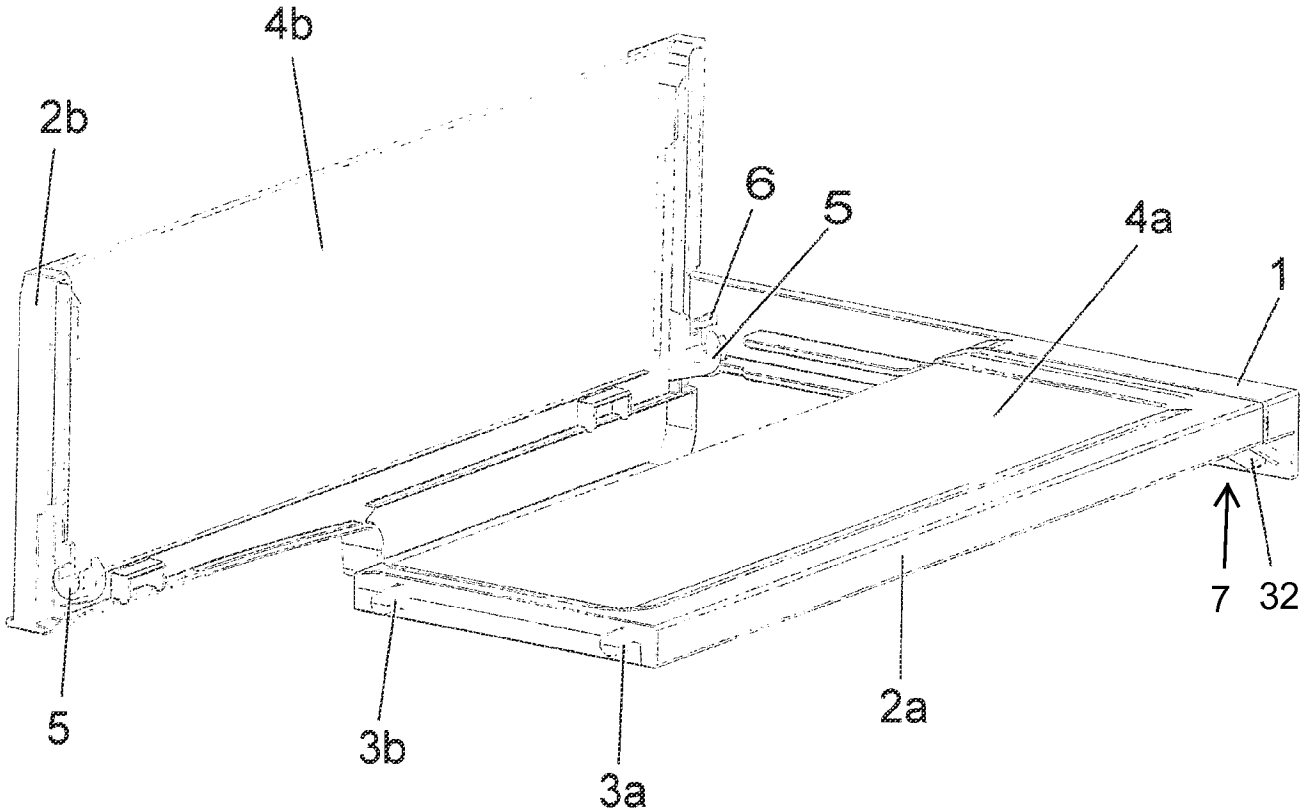
FIG. 5 illustrates, in a perspective view, an arrangement of the shelves in the position when only the rear part is vertically bounced, remaining the front part extended.

FIG. 5 shows, in addition to the support guide 1, the front shelf in the extended position and the rear shelf in the bounced position. In this arrangement, it can be clearly visualized the fitting between the lower recess 5 of the frame 2*b* and the fitting mean 6 in the side guide 1. To comprise this arrangement, being the set fully extended, the front part of the base 4*b* is raised in the same angle relative to the bounce of the set of two shelves illustrated in FIG. 4.

Although it is illustrated a set of two shelves, there may be other embodiments with a larger number of shelves using the same concept represented herein, and it should be understood that this amendment is included in alternative modes of the application.

Likewise, the side support guides 1 may, in alternative embodiments, be conformed so as to enable transversal, vertical or circumferential movement. Further there may be embodiment in which the shelves are moved in multiple stages, through a plurality of directions of movement.

In addition, this invention is not limited to the representations mentioned or illustrated herein, and it has to be comprehended in its wide scope. Many changes and other representations of the invention will come in mind of those skilled in the art to which this invention belongs, having the learning benefit presented in previous descriptions and attached drawings. It is to be understood that the invention is not limited to the disclosed specific shape and that changes and other shapes are understood as enclosed within the scope of the claims below. Although specific terms are nominated herein, they are only used in a generic and descriptive form and not for a limiting purpose.

The invention claimed is:

1. Sliding shelves for refrigerators and freezers comprising:

a front base (4*a*), substantially rectangular, partially covered by a front frame (2*a*) provided with at least two lateral protuberances (3*a*/3*b*);

a rear base (4*b*), substantially rectangular, partially covered by a rear frame (2*b*) provided with at least one lower recess (5);

lateral support guides (1) attached to inner walls of such refrigerators and freezers and each provided with a track (20) and a plurality of fitting means (6), central fittings (8) and a resilient locking means (7), being shaped so as to provide support, fitting, and rotation of the rear frame (2*b*) and also to allow the essentially longitudinal movement of the front frame (2*a*), characterized in that the locking means (7) is resiliently adapted to lock the respective protuberance (3*a*) of the front frame (2*a*) in the end fitting (40) of the lateral support guides (1) to prevent the front frame (2*a*) from moving along the track (20) of the support guides (1) when the shelves are arranged in an extended position, wherein the locking means comprises a resilient arm (34) that is coupled to the track (20) and is arranged upwards at an angle, relative to the track (20), to form an incline ramp (35) that leads to the end fitting (40), and wherein the resilient arm (34) further comprises an end (36) that resiliently blocks the protuberances (3*a*) in the end fitting (40), and a handle (32) that is movable to cause the end (36) of the resilient arm (34) to be temporarily moved downwards a sufficient amount to enable the protuberance (3*a*) to leave the end fitting (40).

2. Sliding shelves for refrigerators and freezers, in accordance with claim 1, characterized by the front base (4*a*) capable of being attached to the rear base (4*b*) through the coupling of its respective frames (2*a*/2*b*).

3. Sliding shelves for refrigerators and freezers, in accordance with claim 1, characterized by the shelves being configured to be arranged in at least four different static positions.

4. Sliding shelves for refrigerators and freezers, in accordance with claim 1, characterized by the lateral support guides (1) shaped in sides of internal accessories of refrigerators and freezers.

5. Sliding shelves for refrigerators and freezers, in accordance with claim 1, characterized by the lateral support guides shaped so as to allow for rotation, transversal, and vertical movement of the constituent bases.

6. Sliding shelves for refrigerators and freezers, in accordance with claim 1, characterized by the handle (32) being movable downwards to cause the end (36) of the resilient arm (34) to be temporarily moved downwards a sufficient amount to enable the protuberance (3*a*) to leave the end fitting (40) and travel downwards along the ramp (35).

7. Sliding shelves for refrigerators and freezers, in accordance with claim 6, characterized by the end fitting (40) comprising a lower stopper shelf (42), wherein the resilient arm (34) is movable downwards until the end (36) contacts the lower stopper shelf (42).

8. Sliding shelves for refrigerators and freezers, in accordance with claim 6, characterized by an angle of the guide (1) being different than the angle of the ramp (35) such that interference of the protuberance (3*a*) between the guide (1) and the resilient arm (34) near the top of the ramp (35) forces the end (36) to be temporarily moved downwards a sufficient amount to enable the protuberance (3*a*) to enter the end fitting (40).

9. Sliding shelves for refrigerators and freezers, in accordance with claim 8, characterized by once the protuberance (3*a*) moves beyond the end (36), the resilient arm (34) naturally returns to a position that prevents the protuberance (3*a*) from leaving the end fitting (40).

* * * * *